US009203131B2

(12) United States Patent
Park et al.

(10) Patent No.: US 9,203,131 B2
(45) Date of Patent: Dec. 1, 2015

(54) BAND STOP FILTER

(75) Inventors: Nam-Shin Park, Gyeonggi-do (KR); Don-Yong Lee, Gyeonggi-do (KR); Jae-Hong Kim, Gyeonggi-do (KR)

(73) Assignee: KMW INC., Hwaseong, Gyeonggi-Do (KR)

( * ) Notice: Subject to any disclaimer, the term of this patent is extended or adjusted under 35 U.S.C. 154(b) by 500 days.

(21) Appl. No.: 13/255,611

(22) PCT Filed: Mar. 15, 2010

(86) PCT No.: PCT/KR2010/001602

§ 371 (c)(1),
(2), (4) Date: Sep. 9, 2011

(87) PCT Pub. No.: WO2010/107215

PCT Pub. Date: Sep. 23, 2010

(65) Prior Publication Data

US 2011/0316650 A1 Dec. 29, 2011

(30) Foreign Application Priority Data

Mar. 16, 2009 (KR) ..... 10-2009-0022380
Apr. 14, 2009 (KR) ..... 10-2009-0032298

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)

(58) Field of Classification Search
CPC ..... H01P 1/202; H01P 1/2053; H01P 7/04
USPC ..... 333/206, 207, 222–226
See application file for complete search history.

(56) References Cited

U.S. PATENT DOCUMENTS 2,281,247 A * 4/1942 Peterson ..... 333/234
3,703,689 A * 11/1972 McAtee ..... 333/223

(Continued)

FOREIGN PATENT DOCUMENTS

CN 200997433 Y 12/2007
CN 201134487 Y 10/2008

(Continued)

*Primary Examiner* — Robert Pascal
*Assistant Examiner* — Gerald Stevens
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a band stop filter comprising: a resonating bar; a housing on the inside of which is formed a receiving space where the resonating bar is positioned, and which is made in a stepped form such that at least one part of an upper-end part is narrower than a lower-end part in terms of the internal width of the receiving space during the formation of the receiving space; a lower cover which has the resonating bar fitted thereto, is joined to the lower part of the housing and, when so joined, is assembled such that the resonating bar is inserted into the receiving space, and which forms the floor surface of the receiving space; and a hermetic-sealing cover which is provided within a recess pre-made in the housing in such a way as to couple with a resonator formed by the receiving space and the resonating bar on the inside of the receiving space, and is designed to hermetically seal the recess in the housing where a transmission line has been provided.

12 Claims, 5 Drawing Sheets

(56) References Cited

U.S. PATENT DOCUMENTS

| | | | | |
|---|---|---|---|---|
| 4,437,076 | A * | 3/1984 | Makimoto et al. | 333/206 |
| 4,794,354 | A * | 12/1988 | Dinsmore et al. | 333/207 |
| 5,389,903 | A * | 2/1995 | Piirainen | 333/203 |
| 6,320,482 | B1 * | 11/2001 | Ala-Kojola et al. | 333/206 |
| 6,362,707 | B1 * | 3/2002 | Reinhardt | 333/219.1 |
| 6,396,366 | B1 * | 5/2002 | Raty et al. | 333/222 |
| 2007/0273459 | A1 * | 11/2007 | Puoskari et al. | 333/206 |

FOREIGN PATENT DOCUMENTS

| | | | |
|---|---|---|---|
| JP | 11-298213 | 10/1999 | H01P 7/04 |
| JP | 2001-211005 | 8/2001 | H01P 1/205 |
| JP | 2005-159597 | 6/2005 | H01P 7/10 |
| JP | 2008-148280 | 6/2008 | H01P 7/04 |
| KR | 10-0449226 | 9/2004 | H01P 1/213 |

* cited by examiner

BAND STOP FILTER

This application makes reference to and claims all benefits from an application entitled BANDSTOP FILTER filed in the Korean Intellectual Property Office on Mar. 15, 2010 and there duly assigned Serial No. PCT/KR2010/001602 which in turn claims a priority to an earlier Korean Patent Application No. 10-2009-0022380 filed on Mar. 16, 2009 and Korean Patent Application No. 10-2009-0032298 filed on Apr. 14, 2009.

TECHNICAL FIELD

The present invention relates to a Radio Frequency (RF) filter using a resonator, and more particularly to a band stop filter included in the radio frequency filter.

BACKGROUND ART

In general, a radio frequency filter (a DR filter, a cavity filter, a waveguide filter, etc.) using a resonator has a kind of circuit tube structure to resonate a radio frequency, particularly, a super high frequency. Since a general resonant circuit including a coil and a condenser has a high radiation loss, the resonant circuit is not suitable to form a super high frequency. The RF filter includes a plurality of resonators, and each resonator forms a metal cylindrical or rectangular cavity surrounded by a conductor. The resonator has a Dielectric Resonance (DR) element or a resonance element including a metal resonant bar within the resonator, and allows only an electromagnetic field of a natural frequency to exist therein, so that the resonator has a structure enabling a resonance of a super high frequency.

As described above, the radio frequency filter using the resonator is largely divided into a Band Pass Filter (BPF) and a band stop filter according a filtering characteristic of the frequency band. At this time, the band stop filter is called a band cutoff filter or a band stop filter.

Such a band stop filter (as well as the band pass filter) has been constantly researched and developed to improve and easily adjust the filtering characteristic, and particularly, active research is also being progressed to restrain a noise generation due to various parasitic resonance modes.

DISCLOSURE

Technical Problem

Accordingly, an aspect of the present invention is to provide a band stop filter, which can effectively restrain the generation of various parasitic resonance modes.

Further, another aspect of the present invention is to provide a band stop filter, which may be implemented as a filter having a smaller size.

Moreover, yet another aspect of the present invention is to provide a band stop filter having easy tuning of a filtering characteristic.

Technical Solution

In accordance with an aspect of the present invention, there is provided a band stop filter including: a resonant bar; a housing for forming a cavity in which the resonant bar is located, and designing the cavity to have a multi-stage structure in such a manner that a width of at least a part of an upper end portion of the cavity is narrower than that of a lower end portion of the cavity in forming the cavity; a lower cover to which the resonant bar is mounted, the lower cover being coupled to a lower part of the housing and being assembled such that the resonant bar is inserted into the cavity when being coupled to the housing, the lower cover defining as a bottom surface of the cavity; a transmission line installed within a groove preset to the housing such that the transmission line is coupled to a resonator formed by the cavity and the resonant bar within the cavity, and connected between a signal input terminal and a signal output terminal of the band stop filter; and an airtight cover for sealing the groove of the housing where the transmission line is installed.

Advantageous Effects

The aforementioned band stop filter according to the present invention can effectively restrain the generation of various parasitic resonance modes, so that the band stop filter has a wideband pass band and easy tuning of a filtering characteristic, and may be implemented as a filter having a smaller size.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Hereinafter, exemplary embodiments of the present invention will be described in detail with reference to the accompanying drawings. In the following description, particular matters such as a specific component are provided only to help general understanding of the present invention, and it is apparent to those skilled in the art that various changes or modifications are possible without departing from the scope and spirit of the invention as defined by the appended claims.

Figure 1:
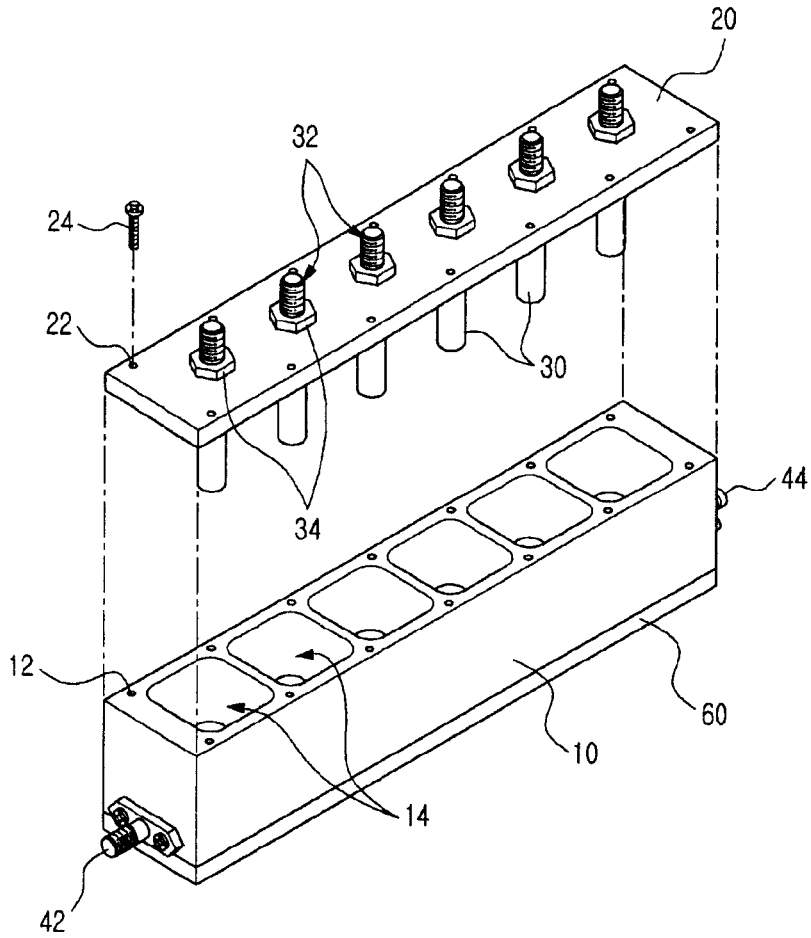
FIG. 1 is a partially exploded perspective view of a band stop filter according to an embodiment of the present invention.

FIG. 1 is a partially exploded perspective view of a band stop filter according to an embodiment of the present invention. FIG. 1 illustrates a state as view from the bottom where a lower cover 20 is separated from a housing 10 from a lower side for convenience. FIGS. 2A and 2B are a partially cutaway plan view and a partially cutaway side view of FIG. 1. FIG. 2A illustrates a plan surface in a state before an airtight cover 60 of FIG. 1 is coupled for convenience, and FIG. 2B illustrates a side surface taken along line A-A' of FIG. 2A. FIGS. 3A, 3B, and 3C are a partially cutaway plan view, a partially cutaway side view, and a partially cutaway bottom view of a housing 10 of FIG. 1, respectively. FIG. 3A illustrates a plan surface of the housing 10, FIG. 3B illustrates a side surface of the housing 10 taken along line A-A' of FIG. 2A, and FIG. 3C illustrates a bottom surface of the housing 10. FIGS. 4A and 4B are a plan view and a side view of a signal transmission line 50 of FIG. 1, respectively. FIG. 4A illustrates a plan surface of the signal transmission line 50, and FIG. 4B illustrates a side surface of the signal transmission line 50.

Referring to FIGS. 1 to 4, a band stop filter according to an embodiment of the present invention has a plurality of cavities 14 accommodating resonant bars 30 made of, for example, a metal material such as brass, iron, etc., the plurality of cavities 14 being partitioned by partition walls. Each of the cavities 14 may be formed through a cutting process in a housing 10 made of a material such as an aluminum alloy, etc. Each cavity 14 and the resonant bar 30 installed within the corresponding cavity 14 form one resonator.

At this time, each resonant bar 30 is mounted to a lower cover 20 according to an aspect of the present invention, and may be assembled in such a manner that each resonant bar 30 is collectively inserted into each cavity 14 when the lower cover 20 is coupled to the housing 10 through screw coupling, etc. Accordingly, an inner bottom surface of each cavity 14 is defined by the lower cover 20. As illustrated in FIG. 1 more clearly, a plurality of screw holes 22 and a plurality of screw recesses 12 are formed at proper positions of the lower cover 20 and the housing 10 corresponding to the lower cover 20, and the lower cover 20 may be coupled to the housing 10 by screws 24 fastened to the screw holes 22 and the screw recesses 12.

Figure 4:
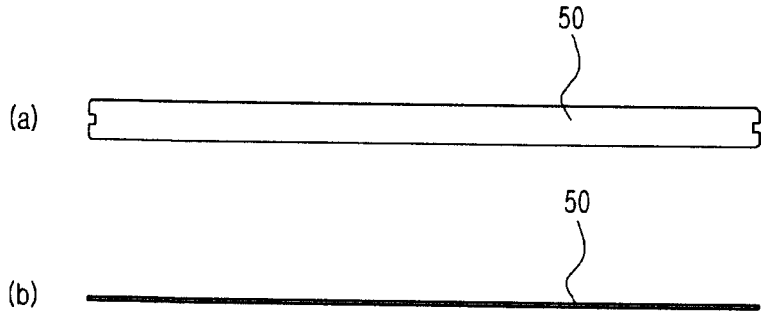
FIGS. 4A and 4B are a plan view and a side view of a signal transmission line of FIG. 1, respectively.

Further, a transmission line 50 for being coupled to the resonator formed by each cavity 14 and the resonant bar 30 within a corresponding cavity 14 is installed at an upper part of each resonator structure. The transmission line 50 is arranged in a row, for example, in a linear shape, a zigzagged shape, a circular shape, etc. to connect a signal input terminal 42 with a signal output terminal 44 of a corresponding band stop filter, so that the transmission line 50 transmits a signal input through the input terminal 42 and output through the output terminal 44. At this time, a corresponding frequency band is coupled and removed by the resonator located at a lower part of a filter while a corresponding signal passes through the transmission line 50, which allows the corresponding filter to have a band stop characteristic. As illustrated in FIG. 4 more clearly, such a transmission line 50 may have a band shape, or may have shapes such as a 50Ω cable, a square bar, etc.

The transmission line 50 may be, for example, installed within a groove properly formed at an upper part of the resonator in the housing 50, and the airtight cover 60 for sealing the groove, in which the transmission line 50 is installed, is coupled to an upper part of the transmission line 50 installed as described above, that is, an upper part of the housing 10 through screw coupling, which finally forms the band stop filter.

Figure 2:
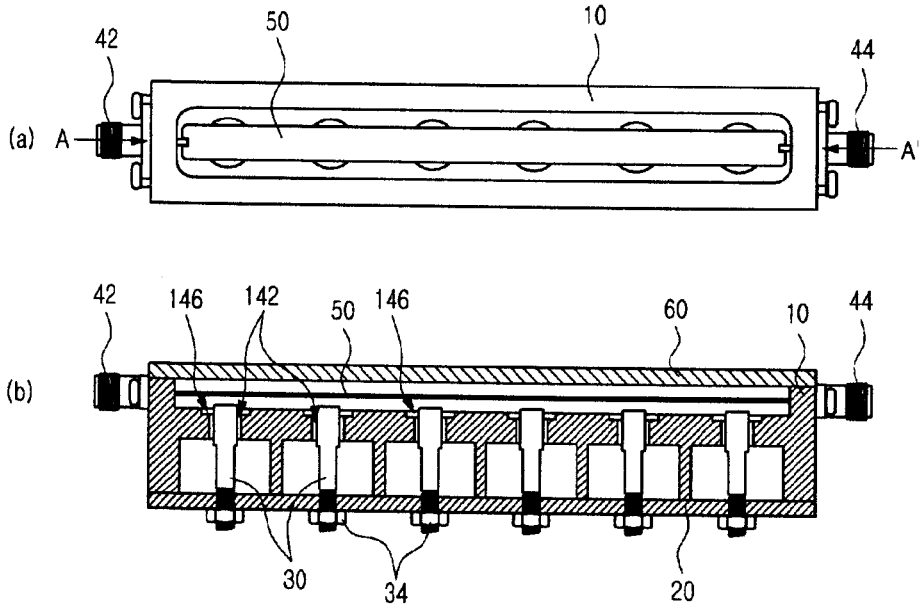
FIGS. 2A and 2B are a partially cutaway plan view and a partially cutaway side view of FIG. 1, respectively.
Figure 3:
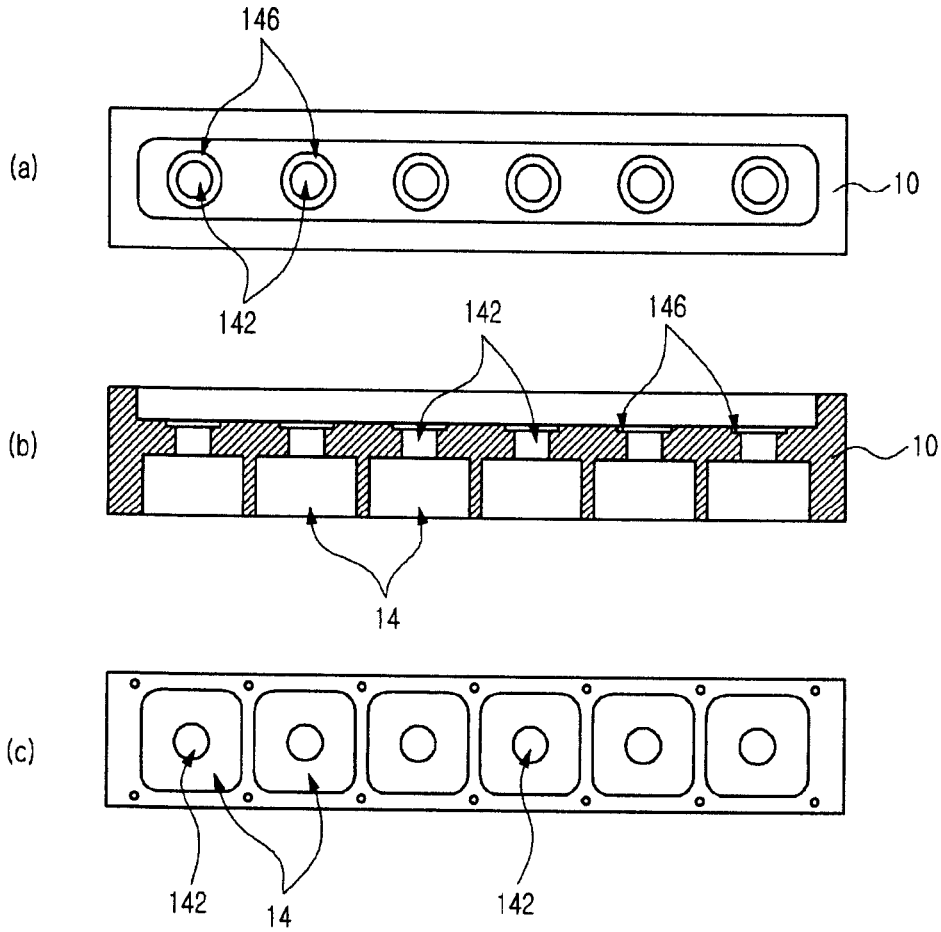
FIGS. 3A, 3B, and 3C are a partially cutaway plan view, a partially cutaway side view, and a partially cutaway bottom view of a housing of FIG. 1, respectively.

In the band stop filter constructed as described above, an inner width of the cavity 14 is designed such that a width of at least a part of an upper end portion 142 of the cavity 14 is generally narrower than a lower end portion, so that the cavity 14 has a multi-stage structure according to an aspect of the present invention. As illustrated in FIGS. 2 and 3 clearly, the upper end portion 142 of the cavity 14 has a narrow width to be quite close to a side surface of an upper end portion of the resonant bar 30. Examples of FIGS. 1 to 4 illustrate that a sectional shape of the lower end portion of the cavity 14 is substantially formed as a square, and a sectional shape of the upper end portion of the cavity is formed as a circle. Of course, in such a sectional shape of the cavity, the lower end portion may be formed as a circle or various shapes. As described above, setting the upper end portion 142 of the cavity 14 to have a narrow width in such a manner that the upper end portion 142 of the cavity 14 is close to the side surface of the upper end portion of the resonant bar 30 is to increase a capacitance generated between the upper end portion 142 of the cavity 14 and (the side surface of the upper end portion of) the resonant bar 30.

In general, in the band stop filter, a cutoff frequency is designed by an LC resonance. A length of the resonant bar 30 mostly influences an inductance (L), and a gap formed between the resonant bar 30 and the cavity 14 closely influences the capacitance (C). In the present invention, the resonator is designed in such a manner that the capacitance (C) of the resonator is increased, and the inductance (L) of the resonator is reduced when the resonator corresponding to a desired cutoff frequency is designed in order to restrain a generation of a parasitic resonance mode (e.g. a TE mode, a TM mode, etc.) other than a main resonance mode (e.g. a TEM mode) required for a corresponding resonator. Further, in order to restrain a parasitic resonance mode generated in a cavity itself, a size of the cavity should be designed as small as possible.

As described above, in the present invention, a capacitance generated between the upper end portion 142 of the cavity 14 and the resonant bar 30 may be significantly increased by setting the upper end portion 142 of the cavity 14 to have a narrow width, and an inductance may be decreased as the capacitance is increased in the resonator. Accordingly, the resonator may be designed such that secondary and tertiary parasitic modes of the resonant bar 30 are generated leaving a pass band by designing the resonant bar 30 to have a shorter length. Further, lengths of the whole cavities may be shorter and sizes of the cavities may be also smaller, so that the filter may be designed to have a smaller size.

At this time, as a width of the upper end portion 142 of the cavity 14 is narrower or the number of portions having a narrow width is increased, the capacitance may be further increased. However, in such a case, overall characteristics are deteriorated such as a weakened coupling between the transmission lines 50 in a corresponding resonator. Accordingly, in the present invention, the width of the upper end portion 142 of the cavity 14 and a ratio of the upper end portion 142 to the lower end portion are properly designed considering the above problem.

Further, at this time, in order to adjust a coupling between the resonator and the transmission line 50, a coupling adjusting recess 146 may be formed in an end of the upper end portion 142 of the cavity 14 as illustrated in FIGS. 2 and 3 more clearly. Accordingly, it is possible to adjust an amount of a band stop coupling by varying a size of the coupling adjusting recess 146.

Meanwhile, although the resonant bar 30 is generally installed such that the resonant bar 30 is fixed to a bottom surface within the cavity 14, the lower end portion of the resonant bar 30 may have a screw structure 32 and the screw structure 32 may be constructed such that the screw structure 32 has a length to somewhat protrude toward an outside of the lower cover 20 through a screw hole formed at a proper position of the lower cover 20 according to an aspect of the present invention as illustrated in FIGS. 1 and 2 more clearly.

Further, a nut 34, which is coupled to the screw structure 32 of the resonant bar 30 to fix the resonant bar 30, is provided on an outside of the lower cover 20.

As described above, forming the screw structure 32 at the resonant bar 30 is to enable the frequency tuning in each resonator without providing a tuning screw for the separate frequency tuning. In the present invention, it is possible to perform the frequency tuning by properly adjusting a position of the resonant bar 30 through an insertion or a withdrawal of the screw structure 32 of the resonant bar 30.

Meanwhile, an example of FIGS. 2A and 2B illustrates the resonant bar 30 having the upper end portion and the lower end portion, the upper end portion and the lower end portion having different sizes from each other. That is, the lower end portion of the resonant bar 30 may be formed to have a narrower width than the upper end portion of the resonant bar 30. The above structure is to lower a cutoff frequency. At this time, if the width of the lower end portion is too narrow, it has a bad influence on a Q (Quality factor) characteristic.

Figure 5:
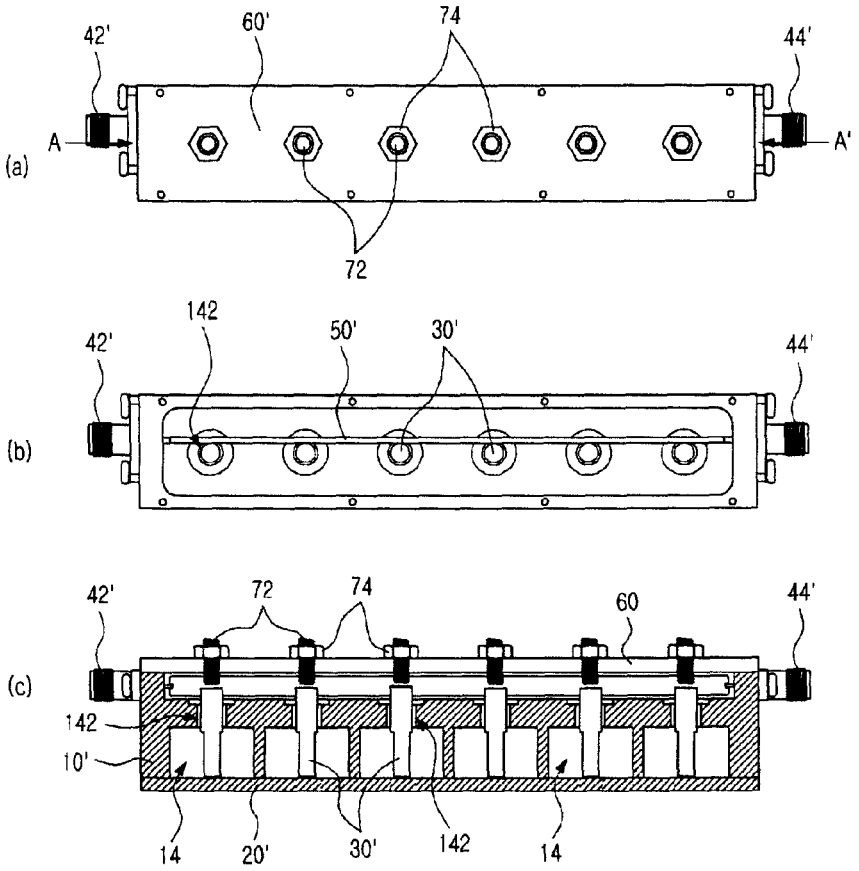
FIGS. 5A, 5B and 5C are plan views and a partially cutaway side view of a band stop filter according to another embodiment of the present invention.

FIGS. 5A, 5B and 5C are plan views and a partially cutaway side view of a band stop filter according to another embodiment of the present invention. FIG. 5A is a plan view in a state where an upper cover 60' is coupled to the housing, FIG. 5B is a plan view in a state before the upper cover 60' is coupled to the housing, and FIG. 5C is a side view taken along line A-A' of FIG. 5A. Referring to FIGS. 5A to 5C, a band stop filter according to another embodiment of the present invention forms resonators through a plurality of cavities 14, each of the cavities accommodating a resonant bar 30' similarly constructed as the embodiment illustrated in FIGS. 1 to 4. Each cavity 14 is designed to have a multi-stage structure in such a manner that the upper end portion 142 of the cavity 14 has a narrower width than the lower end portion of the cavity 14.

However, in a structure of another embodiment of the present invention, a lower end portion of the resonant bar 30' has no screw structure, and is fixedly mounted to a lower cover 20'. Further, a transmission line 50' is installed to be spaced away from a center axis of the resonator to a side (in a state where the band shape is stood up) and connected to an input terminal 43' and an output terminal 44' of a corresponding band stop filter according to another embodiment of the present invention. Further, an upper part of the transmission line 50 installed as described above may be again coupled to the upper cover 60' for sealing an upper part of the housing 10' through screw coupling. The upper cover 60' has a screw hole formed at a position corresponding to each resonant bar 30', and a tuning screw 72, which can adjust a coupling with the resonant bar 30' corresponding to the position, is installed in each screw hole in such a manner that the tuning screw 42 has a length to internally and externally protrude from the upper cover 60' and the tuning screw 72 can be inserted into and withdrawn from the upper cover 60'. Further, a nut 74, which is coupled to the tuning screw 72 to fix the tuning screw 72, is provided at an outside of the upper cover 60'.

The characteristic of the band stop filter having the above construction according to another embodiment of the present invention enables the frequency tuning in each resonator by fixing the resonant bar 30' and using the separate tuning screw 72 in comparison with an embodiment of FIGS. 1 to 4.

Figure 6:
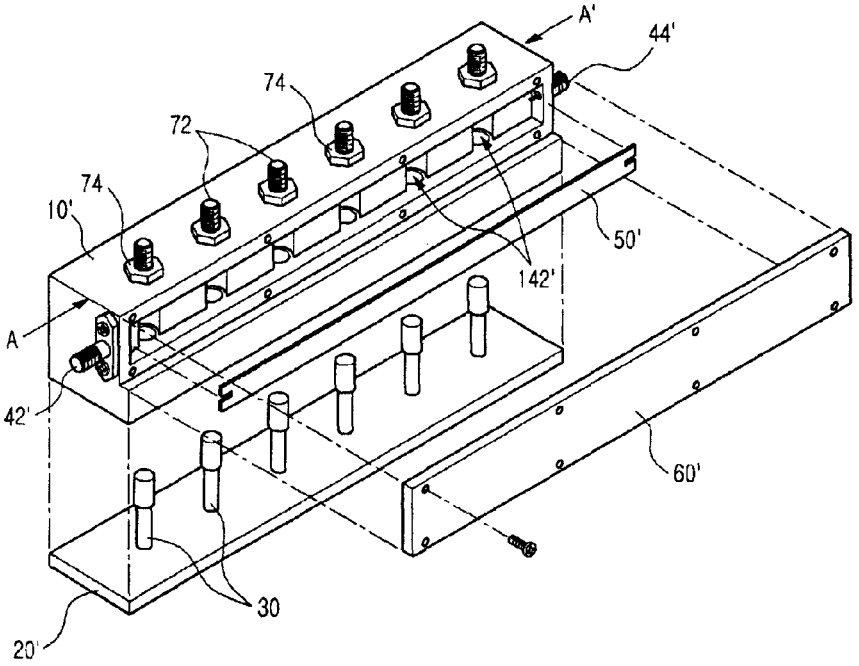
FIG. 6 is a partially exploded perspective view of a band stop filter according to another embodiment of the present invention.
Figure 7:
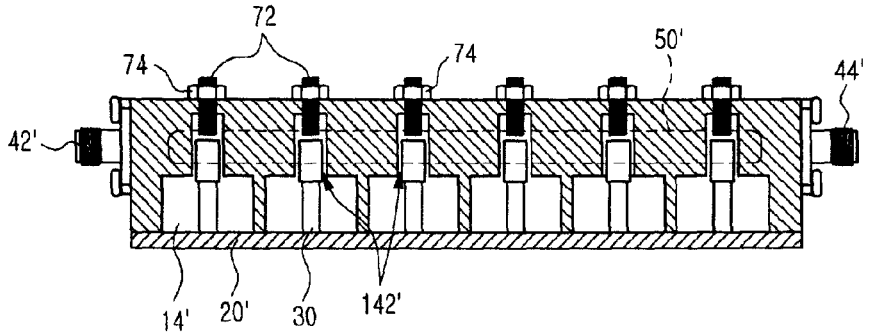
FIG. 7 is a partially cutaway side view of FIG. 6.

FIG. 6 is a partially exploded perspective view of a band stop filter according to another embodiment of the present invention. FIG. 7 is a partially cutaway side view of FIG. 6, and is also a side view taken along line A-A' of FIG. 6. Referring to FIGS. 6 and 7, the band stop filter according to another embodiment of the present invention forms resonators through a plurality of cavities 14', each of the cavities accommodating the resonant bar 30' similarly constructed as the embodiment illustrated in FIGS. 1 to 4. Each cavity 14 is designed to have a multi-stage structure in such a manner that an upper end portion 142' of the cavity has a narrower width than the lower end portion of the cavity.

However, in a structure of another embodiment of the present invention, a lower end portion of the resonant bar 30' has no screw structure, and is fixedly mounted to the lower cover 20'. Further, the transmission line 50' is installed within a groove properly formed at a position corresponding to a side surface of an upper part of the resonator in the housing 10' (in a state where a band shape is stood up), and connected to the input terminal 42' and the output terminal 44' of the corresponding band stop filter, which are formed at a corresponding position of an outside of the housing 10', according to another embodiment of the present invention. Further, an airtight cover 60' for sealing the groove of the housing 10', in which the transmission line 50' is installed, is coupled to the side surface of the housing 10' through screw coupling.

In addition, an upper plate of the housing 10' has a screw hole formed at a position corresponding to each resonant bar 30', and a tuning screw 72, which can adjust a coupling with the resonant bar 30' corresponding to the position, is installed in each screw hole in such a manner that the tuning screw 42 has a length to internally and externally protrude from the upper plate of the housing 10' and the tuning screw 72 can be inserted into and withdrawn from the upper plate of the housing 10'. Moreover, the nut 74, which is coupled to the tuning screw 72 to fix the tuning screw 72, is provided on an outside of the upper plate of the housing 10'.

The characteristic of the band stop filter having the above construction according to another embodiment of the present invention further enables the frequency tuning in each resonator by fixing the resonant bar 30' and using the separate tuning screw 72 in comparison with an embodiment of FIGS. 1 to 4.

Figure 8:
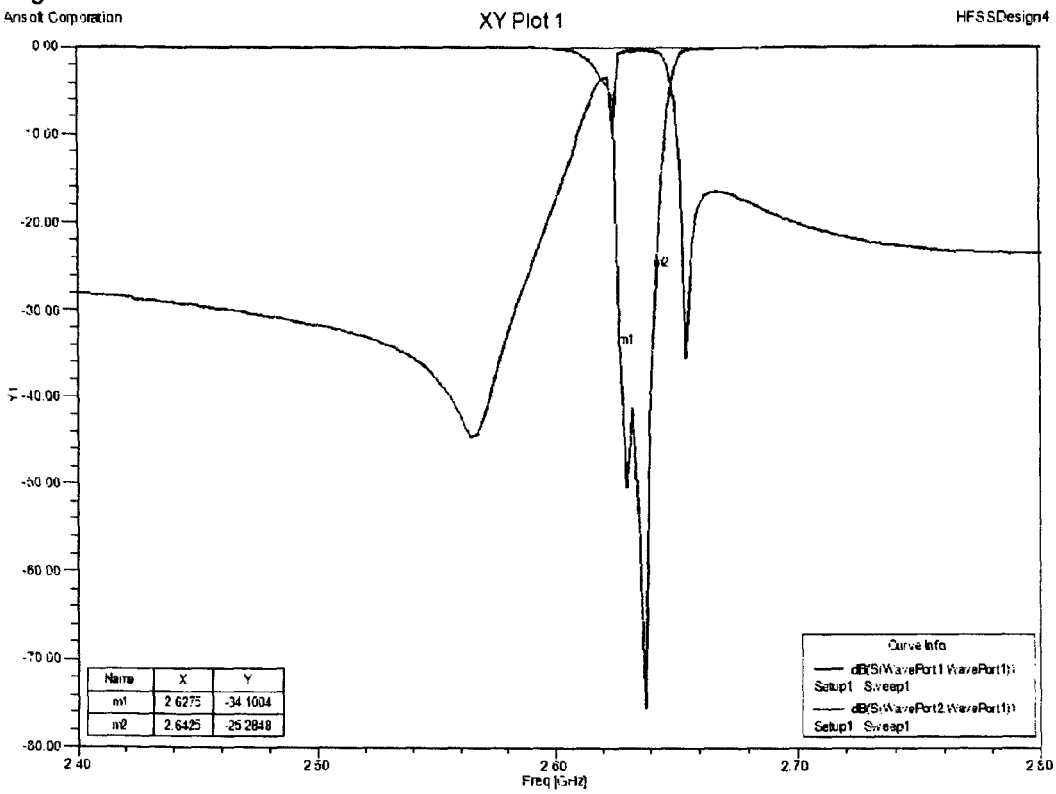
FIGS. 8 and 9 are graphs showing a band stop characteristic of a band stop filter according to an embodiment of the present invention.
Figure 9:
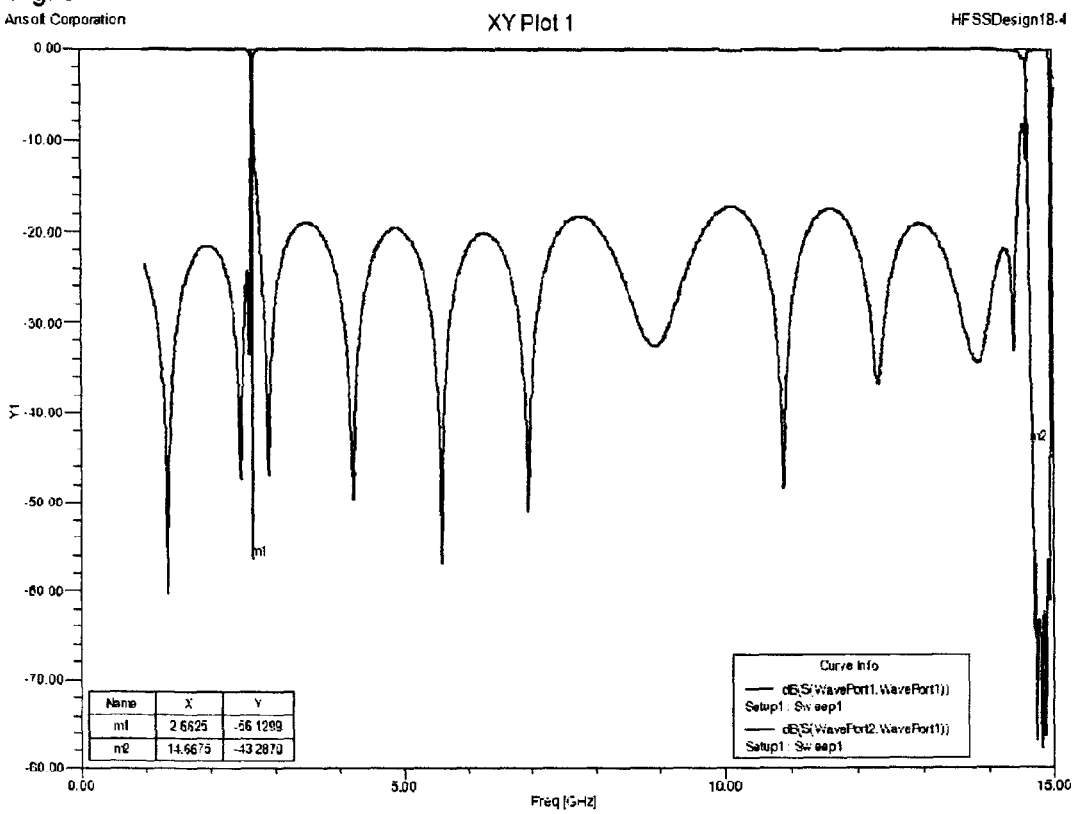

FIGS. 8 and 9 are graphs showing a band stop characteristic of a band stop filter according to an embodiment of the present invention. Referring to FIGS. 8 and 9, the band stop filter according to the present invention, for example, has a center cutoff frequency of about a 2.64 GHz band, and mostly prevents an effect of other parasitic resonance modes up to about a 14.7 GHz band. That is, the present invention designs the cavity such that a part (or all) of the upper end portions of the cavities has a narrower width than the lower end portion of the cavity so that a gap between the resonant bar and the upper end portion of the cavity may be narrowed and a capacitance in an LC resonance may be increased. As a result, secondary and tertiary parasitic frequencies of the resonant bar may be raised to fifth and sixth or more parasitic frequencies. Furthermore, a size of the cavity may be smaller, so that several parasitic modes generated in the cavity itself may be raised to a desired frequency (approximately, six to seven times as much as the stop frequency).

As described above, the band stop filter according to embodiments of the present invention may be constructed and operated. While the present invention has been shown and described with reference to certain preferred embodiments thereof, it will be understood by those skilled in the art that various changes and modifications may be made therein without departing from the spirit and scope of the present invention as defined by the appended claims. For example, in the above description, an embodiment of the present invention has described a structure where frequency tuning is possible by the insertion or withdrawal of the resonant bar itself, and another embodiment of the present invention has described a structure where the frequency tuning is possible by providing the separate tuning screw. However, other embodiments of the present invention may employ a structure where the two structures are combined, that is, a structure having both schemes of providing the separate tuning screw and the insertion and withdrawal of the resonant bar itself. Accordingly, various changes and modifications may be made in the present invention and the scope of the invention is not to be limited by the above embodiments but by the claims and the equivalents thereof.

The invention claimed is:

1. A band stop filter comprising:

a resonant bar;

a housing having sidewalls such that an upper portion of the sidewalls are thicker than a lower portion of the sidewalls forming a cavity in which the resonant bar is located to form a resonator, and having a multi-stage structure in which a width of an upper end portion of the cavity defined by the sidewalls is less than that of a lower end portion of the cavity defined by the sidewalls such that when the resonant bar is inserted in the cavity, a first distance between the upper end portion of the cavity defined by the sidewalls and the resonant bar is less than that of a second distance between the lower end portion of the cavity defined by the sidewalls and the resonant bar, and an upper surface of the cavity extending between the sidewalls having a through hole corresponding to a position of the resonant bar thereby allowing the resonant bar to extend into an upper cavity of the housing, wherein the upper cavity of the housing is located above the through hole;

a lower cover to which the resonant bar is mounted, the lower cover being coupled to a lower part of the housing such that the resonant bar is inserted into the cavity and coupled to the housing, the lower cover defining a bottom surface of the cavity;

a transmission line installed within a groove preset to the upper cavity of the housing such that the transmission line is coupled to the resonator formed by the cavity and the resonant bar within the cavity, and connected between a signal input terminal and a signal output terminal of the band stop filter; and an airtight cover for sealing the groove of the housing where the transmission line is installed.

2. The band stop filter as claimed in claim 1, wherein a lower end portion of the resonant bar has a screw structure, the screw structure has a length to protrude toward an outside of the lower cover through a screw hole formed at a position corresponding to a position where the resonant bar of the lower cover is installed, and a nut is provided on the outside of the lower cover, the nut being coupled to the screw structure of the resonant bar to fix the resonant bar.

3. The band stop filter as claimed in claim 2, wherein a tuning screw hole is formed at a position corresponding to the resonant bar in an upper plate of the housing, a tuning screw, which can adjust a coupling with the resonant bar corresponding to the position, is installed in the tuning screw hole in such a manner that the tuning screw has a length to internally and externally protrude from the upper plate of the housing and can be inserted into and withdrawn from the upper plate of the housing, and a nut, which is coupled to the tuning screw to fix the tuning screw, is provided on the outside of the upper plate of the housing.

4. The band stop filter as claimed in claim 3, wherein the lower end portion of the resonant bar has a narrower width than an upper end portion of the resonant bar.

5. The band stop filter as claimed in claim 3, wherein a coupling adjusting recess is formed in an end of the upper end portion of the cavity.

6. The band stop filter as claimed in claim 2, wherein the lower end portion of the resonant bar has a narrower width than an upper end portion of the resonant bar.

7. The band stop filter as claimed in claim 2, wherein a coupling adjusting recess is formed in an end of the upper end portion of the cavity.

8. The band stop filter as claimed in claim 1, wherein a screw hole is formed at a position corresponding to the resonant bar in an upper plate of the housing, a tuning screw, which can adjust a coupling with the resonant bar corresponding to the position, is installed in the screw hole in such a manner that the tuning screw has a length to internally and externally protrude from the upper plate of the housing and can be inserted into and withdrawn from the upper plate of the housing, and a nut, which is coupled to the tuning screw to fix the tuning screw, is provided on the outside of the upper plate of the housing.

9. The band stop filter as claimed in claim 8, wherein a lower end portion of the resonant bar has a narrower width than an upper end portion of the resonant bar.

10. The band stop filter as claimed in claim 8, wherein a coupling adjusting recess is formed in an end of the upper end portion of the cavity.

11. The band stop filter as claimed in claim 1, wherein a lower end portion of the resonant bar has a narrower width than an upper end portion of the resonant bar.

12. The band stop filter as claimed in claim 1, wherein a coupling adjusting recess is formed in an end of the upper end portion of the cavity.

* * * * *